United States Patent [19]

Brown, Jr. et al.

[11] 4,203,974

[45] May 20, 1980

[54] STABLE AQUEOUS FOAM FORMULATION, AND METHOD OF USE THEREOF FOR VISUAL OBSCURATION AND AREA DENIAL

[75] Inventors: Harry A. Brown, Jr., Fallston; Robert F. Durgin, Abingdon, both of Md.

[73] Assignee: The United States of America as represented by the Secretary of the Army, Washington, D.C.

[21] Appl. No.: 886,961

[22] Filed: Mar. 15, 1978

[51] Int. Cl.[2] ..... A01N 11/00; B01J 13/00

[52] U.S. Cl. ..... 424/166; 239/9; 252/307; 261/DIG. 26

[58] Field of Search ..... 252/307; 424/166; 261/DIG. 26; 239/2 R, 9

[56] References Cited

U.S. PATENT DOCUMENTS

| | | | |
|---|---|---|---|
| 2,327,152 | 8/1943 | Flaxman | 424/166 |
| 2,433,625 | 12/1947 | Raspet | 252/307 |
| 2,664,764 | 1/1954 | Blackburn | 252/307 X |
| 3,150,989 | 9/1964 | Parsons | 252/307 X |
| 3,713,404 | 1/1973 | Lavo et al. | 252/307 X |
| 3,814,808 | 6/1974 | Schwendeman et al. | 252/307 X |

*Primary Examiner*—Richard D. Lovering

*Attorney, Agent, or Firm*—Nathan Edelberg; Robert P. Gibson; Kenneth P. Van Wyck

[57] ABSTRACT

An improved, stable high expansion aqueous foam formulation of a single composite solution containing a relatively large amount of ammonia. A method of using the ammonia aqueous foam for visual obscuration and area denial is also disclosed.

11 Claims, No Drawings

STABLE AQUEOUS FOAM FORMULATION, AND METHOD OF USE THEREOF FOR VISUAL OBSCURATION AND AREA DENIAL

DEDICATORY CLAUSE

The invention described herein may be manufactured, licensed, and used by or for the Government for governmental purposes without the payment to us of any royalty thereon.

BACKGROUND OF THE INVENTION

The invention relates to an improved, stable, high-expansion aqueous foam formulation which contains ammonia.

The invention further relates to a method of using an aqueous foam formulation containing ammonia for visual obscuration and area denial in military operations.

The invention still further relates to an aqueous foam formulation containing ammonia which will adhere to surfaces of objects or persons entering or moving about in the foam.

Prior foam formulations in the field have generally been adequate for purposes of visual obscuration. Previous attempts to incorporate ammonia in foams for an additional deterrent effect have been unsuccessful in that the ammonia has seriously degraded the foam stability. Even foams containing less than one percent ammonia have suffered a 50% reduction in foam volume within two to three hours after generation. The prior art attempts have thus suffered the disadvantages of inadequate foam stability with only short-term effectiveness in area denial capabilities. In addition, the low concentration of ammonia in these foams would not have a sufficient deterrent effect against personnel, particularly highly motivated or protected personnel.

The aqueous foam formulation of this invention has succeeded in providing an extended term stability with relatively large amounts of ammonia.

SUMMARY OF THE INVENTION

An improved, stable aqueous foam formulation containing ammonia in a single composite solution for use in visual obscuration and area denial comprising a commercially available high expansion foam liquid concentrate, water, thickening and stabilizing material and a source of ammonia, e.g., ammonium hydroxide in water solution.

It is the principal object of this invention to provide a high-expansion aqueous foam formulation containing a relatively large amount of ammonia.

Another object of this invention is to provide an aqueous foam formulation containing ammonia that is stable over an extended period of time.

A further object of the invention is to provide a method for visual obscuration and area denial through use of a foam formulation which includes ammonia in sufficiently large quantities to serve as a deterrent.

A still further object of this invention is to provide an aqueous foam formulation containing ammonia which will adhere to objects or persons within the foam.

These and other objects will become apparent from the following detailed description of the invention.

DESCRIPTION OF THE INVENTION

The aqueous foam formulation of this invention comprises a commercially available high expansion foam liquid for use in visual obscuration and area denial and a relatively large amount of ammonia. The aqueous foam formulation also includes a combination of thickening and stabilizing materials which aid in stabilizing the aqueous foam formulation for storage and ease of dissemination by conventional apparatus, such as that used for fire fighting purposes. In particular, the incorporation of sucrose as a stabilizing additive produces a "sticky" foam which adheres to the surfaces of objects or persons entering or moving about in the foam. In this manner, the desired visual obscuration effect of the foam is enhanced and the foam tends to clog or block the ports of non self-contained breathing devices, such as gas masks, which could otherwise be used to defeat the effect of ammonia.

The aqueous foam formulations can be prepared using various combinations of conventional thickening and stabilizing materials in the high expansion foam liquid containing ammonia. The ammonia can be supplied in any convenient form, such as a commercially available ammonium hydroxide in water solution (containing 28–30% $NH_3$).

The preferred aqueous foam formulation of this invention comprises a combination of distilled water, a high expansion foam liquid concentrate prepared by combining a surfactant, such as sodium lauryl sulfate, as a principal ingredient with minor amounts of selected stabilizing materials, e.g., the HEF concentrate (sodium lauryl sulfate surfactant), which is commercially available from National Foam Systems, Inc., Lionville, Pa., sucrose and glycerine as thickening and stabilizing agents and ammonia. The components of the formulation are mixed in any order using a minimum of stirring to provide homogenity without excessive foaming in the mixing vessel. The mixture is kept is a closed container to prevent loss of the ammonia or other volatiles before the foam is produced.

In a specific example of the preferred foam formulation, distilled water (56.5 weight percent of the final formulation) is mixed with commercially available HEF high expansion foam liquid concentrate (6 percent by weight); sucrose (15 percent by weight); glycerine (15 percent by weight) and a commercially available solution of ammonium hydroxide in water (28–30% $NH_3$; 7.5 percent $NH_3$ by weight of the formulation). A minimum of stirring was used to provide homogenity without causing excessive foaming in the mixing vessel. The foam produced had an extended-term stability when stored at ambient temperatures for periods of up to three months, with only a minor decrease in resulting foam stability upon generation. In addition, the incorporation of sucrose as a stabilizing additive produced a "sticky" foam which adheres to objects, e.g., glasses or persons exposed to the foam. This adherence effect enhanced the effect of visual obscuration and tended to clog or block the air ports of non self-contained breathing devices, such as gas masks, which would be employed to defeat the effects of the ammonia contained within the foam formulation.

Other examples of the aqueous formulation of this invention were prepared in the same manner as the example above, using either varying amounts of ammonia or varying concentrations of sucrose and glycerin thickening and stabilizing additives. In particular, a foam was prepared containing 18.6% by weight $NH_3$, 15% by weight sucrose, 15% by weight glycerin, 6% by weight high expansion foam concentrate and 45.4% by weight distilled water. The stability of the resulting foam was slightly less than that observed with the 7.5% $NH_3$ foam, but was well within acceptable limits for military foams. A reduction in the foam expansion ratio, i.e., the ratio of the volume of foam to the volume of liquid (formulation) required to generate said volume of foam, was noted with increased concentration of ammonia, but the expansion ratio was still within acceptable dissemination limits. In comparison, a foam formulation containing 15% by weight, each, of glycerin and sucrose, but no ammonia, exhibited a higher than normal expansion ratio and excellent foam stability.

In another example of an aqueous foam formulation containing ammonia, the amount of sucrose and glycerin was increased to 20% by weight each in the formulation of the first example (7.5% by weight $NH_3$) without adverse effects upon foam stability characteristics. Thus, the amount of sucrose and glycerin thickening and stabilizer additive can be varied in the range of 15–20% by weight of each in the total formulation without significant change in foam stability.

The particular amounts of the high-expansion aqueous foam formulations, thickening and stabilizing material can be varied within the skill of one in the art to obtain a foam containing the desired concentration of ammonia and foam stability.

The concentration of ammonia which can be incorporated into the foam formulation of this invention is critical only to the extent that the ammonia will remain in a stabilized foam for an extended period of time, ie., during extended periods of storage and for at least 4 hours after generation of the foam from a dissemination means. Concentration of ammonia up to 15% by weight of the foam formulation has remained stable for the desired period of time and concentrations of the order of 23% by weight have had acceptable stability performance. As a practical matter, ammonia concentrations in the range of 5% to 18% by weight give good stability and are the limits of desired ammonia in a foam formulation used for military deterrence, with the upper range of concentrations being relatively toxic to unprotected personnel exposed to the foam. The optimum concentration of ammonia for use as a deterrent in the foam formulation of this invention has been found to be approximately 7.5% by weight.

The stabilizer and the thickener materials used in the foam formulation of this invention must not react with the ammonia or lower the pH of the foam and will thus not interfere with the stability of the foam. Sucrose and glycerin have been found to be particularly effective in stabilizing the ammonia foam formulation and are therefore preferred, but other polyhydroxylated stabilizers could be used in the formulation of this invention.

The foam formulation of this invention can be generated in various types of apparatus conventionally used for foam generation, such as that used for production of aqueous foams for fire fighting purposes. The aqueous foam may be generated, for example, by spraying the foam formulation evenly over a mesh screen through which a gas, such as air is passed at a controlled rate. Foam bubbles produced at the screen surface would be ejected by the force of the gas flow. Desired foam characteristics can be obtained by selective variation of liquid flow rate, nozzle size and spray pattern, screen mesh size and gas flow rate. A self-contained generator-disperser apparatus, such as the vehicle mounted XM35E1 used by the military for generating riot-control foams, is a suitable apparatus. The apparatus used to generate the novel foam formulation of this invention is not critical however, and is not considered a part of the invention.

The novel foam formulation of this invention for incorporating relatively large amounts of ammonia, as a military and riot-control deterrent, can be obviously modified by including additional deterrent agents, either as an additional deterrent or as a replacement for the ammonia in the preferred foam formulation.

The ammonia-containing foam formulation of this invention provides a single composite solution which is readily disseminated by conventional means and which has superior stability for extended periods of time. The foam formulation of this invention thus allows visual obscuration and effective area denial through use of a stable foam formulation containing substantial amounts of ammonia which can adhere to persons in the dissemination area.

Applicants having disclosed their invention, obvious modification will become apparent to those skilled in the related chemical fields. Applicants therefore wish to be limited only by the scope of the appended claims.

We claim:

1. A stable aqueous foam formulation comprising, in a single composite solution, a conventional high expansion foam liquid concentrate consisting essentially of a sodium lauryl sulfate surfactant as a principal active ingredient in aqueous solution, a glycerin thickener, a sucrose stabilizer and a relatively large amount of ammonia in aqueous solution sufficient to act as an irritant deterrent to persons exposed to said foam formulation.

2. The foam formulation of claim 1 wherein the ammonia is present as the form of a solution of ammonium hydroxide in water.

3. The foam formulation of claim 2 wherein the ammonia hydroxide solution is present in a concentration sufficient to give an ammonia concentration of the order of 7–8 percent by weight of the foam formulation.

4. The foam formulation of claim 1 wherein the ammonia is present in a concentration of from 5% to 18% by weight of the foam formulation.

5. The foam formulation of claim 1 wherein the foam formulation consists of 56.5 wt percent distilled water, 6 wt percent of a high expansion foam liquid concentrate, 15 wt percent sucrose, 15 wt percent glycerin and 7.5 wt percent ammonia.

6. In a method for obtaining visual obscuration and area denial in military operations through dissemination of a high expansion aqueous foam, the improvement comprising the step of using a stable, aqueous foam formulation which comprises a single composite aqueous solution of a conventional high expansion foam liquid consisting essentially of a sodium lauryl sulfate surfactant as a principal active ingredient, a glycerin thickener, a polyhydroxylated stabilizer and a relatively large amount of ammonia as an irritant deterrent to persons exposed to said foam.

7. The method of claim 6 wherein the ammonia is present in the form of an ammonium hydroxide solution in water.

8. The method of claim 7 wherein the ammonium hydroxide solution is present in a concentration sufficient to give an ammonia concentration of the order of 7–8 percent by weight of the foam formulation solution.

9. The method of claim 6 wherein the ammonia is present in a concentration of from 5% to 18% by weight of the foam formulation.

10. The method of claim 6 wherein sucrose is used as the stabilizer to produce a foam which will adhere to objects and persons exposed to said foam.

11. The method of claim 6 wherein the foam formulation consists of 56.5 percent by weight distilled water, 6 percent by weight of a high expansion foam liquid concentrate, 15 percent by weight sucrose, 15 percent by weight glycerin and 7.5 percent by weight of ammonia.

* * * * *